US007168579B2

(12) United States Patent
Richter et al.

(10) Patent No.: US 7,168,579 B2
(45) Date of Patent: Jan. 30, 2007

(54) MERCHANDISING SYSTEM

(75) Inventors: Gary M. Richter, Waukesha, WI (US); M. Scott Bryson, Brookfield, WI (US)

(73) Assignee: DCI Marketing, Inc., Milwaukee, WI (US)

( * ) Notice: Subject to any disclaimer, the term of this patent is extended or adjusted under 35 U.S.C. 154(b) by 0 days.

(21) Appl. No.: 10/656,832

(22) Filed: Sep. 5, 2003

(65) Prior Publication Data

US 2004/0079715 A1 Apr. 29, 2004

Related U.S. Application Data

(60) Provisional application No. 60/408,752, filed on Sep. 6, 2002.

(51) Int. Cl.
*A47F 1/04* (2006.01)

(52) U.S. Cl. ..... 211/59.3

(58) Field of Classification Search ..... 211/59.3, 211/59.2, 59.4, 51, 184; 312/71, 61
See application file for complete search history.

(56) References Cited

U.S. PATENT DOCUMENTS

| | | | | |
|---|---|---|---|---|
| 870,993 | A | 11/1907 | Richardson | |
| 903,368 | A | 11/1908 | Flanders | |
| 1,030,317 | A | 6/1912 | Middaugh | |
| 1,117,255 | A | 11/1914 | Schmidt | |
| 1,750,575 | A | 3/1930 | Cubberley | |
| 2,079,754 | A | 5/1937 | Waxgiser | |
| 2,110,299 | A | 3/1938 | Hinkle | |
| 2,303,275 | A | 11/1942 | Hull | |
| 2,625,162 | A | 1/1953 | Edeborg | |
| 2,652,154 | A | 9/1953 | Stevens | |
| 3,161,295 | A | 12/1964 | Chesley | |
| 3,308,961 | A | 3/1967 | Chesley | |
| 3,348,732 | A | 10/1967 | Schwarz | |
| 3,452,899 | A | 7/1969 | Libberton | |
| 3,893,585 | A | 7/1975 | Morrison et al. | |
| 4,130,203 | A | 12/1978 | Russell, III | |
| 4,300,693 | A | 11/1981 | Spamer | |
| 4,378,872 | A | 4/1983 | Brown | |
| 4,496,127 | A | 1/1985 | Nelson | |
| 4,600,121 | A | 7/1986 | Falk et al. | |
| 4,625,894 | A | 12/1986 | James et al. | |
| 4,685,574 | A | 8/1987 | Young et al. | |
| 4,724,968 | A * | 2/1988 | Wombacher | 211/59.3 |
| 4,730,741 | A | 3/1988 | Jackle, III et al. | |
| 4,762,236 | A | 8/1988 | Jackle, III et al. | |
| 4,830,201 | A | 5/1989 | Breslow | |
| 4,836,390 | A * | 6/1989 | Polvere | 211/59.3 |
| 4,856,659 | A | 8/1989 | Krebs | |
| 4,874,099 | A | 10/1989 | Arnott et al. | |
| 4,901,869 | A * | 2/1990 | Hawkinson et al. | 211/59.3 |

(Continued)

*Primary Examiner*—Jennifer E. Novosad
(74) *Attorney, Agent, or Firm*—Antonia Holland; Godfrey & Kahn S.C.

(57) ABSTRACT

A merchandising system provides for the presentation and storage of articles comprising a base having a front and a back, the base being configured to support the articles and defining a first space for containing the articles. In addition, the merchandising system comprises an assembly for advancing the articles toward the front of the base, wherein the assembly comprises a member configured to extend beyond the base to create a second space for containing the articles in addition to the first space.

23 Claims, 19 Drawing Sheets

U.S. PATENT DOCUMENTS 4,934,645 A 6/1990 Breslow
5,012,936 A 5/1991 Crum
5,069,349 A 12/1991 Wear et al.
5,097,962 A 3/1992 Eklof et al.
5,123,546 A 6/1992 Crum
5,161,702 A 11/1992 Skalski
5,190,186 A 3/1993 Yablans et al.
5,199,584 A 4/1993 Fowler et al.
5,240,126 A * 8/1993 Foster et al. ..... 211/59.3
5,255,802 A 10/1993 Krinke et al.
5,265,738 A 11/1993 Yablans et al.
5,366,099 A * 11/1994 Schmid ..... 211/59.3
5,413,229 A * 5/1995 Zuberbuhler et al. ..... 211/59.3
5,450,969 A 9/1995 Johnson et al.
5,469,976 A * 11/1995 Burchell ..... 211/59.3
5,490,600 A 2/1996 Bustos
5,542,552 A 8/1996 Yablans et al.
5,577,623 A 11/1996 Bustos
5,634,564 A * 6/1997 Spamer et al. ..... 211/59.3
5,638,963 A * 6/1997 Finnelly et al. ..... 211/59.3
5,665,304 A 9/1997 Heinen et al.
5,671,851 A 9/1997 Johnson et al.
5,673,801 A 10/1997 Markson
5,746,328 A 5/1998 Beeler et al.
5,788,091 A 8/1998 Robertson et al.
5,806,690 A * 9/1998 Johnson et al. ..... 211/59.3
5,839,588 A 11/1998 Hawkinson
5,855,281 A * 1/1999 Rabas ..... 211/59.3
5,855,283 A 1/1999 Johnson
5,873,489 A 2/1999 Ide et al.
5,970,887 A 10/1999 Hardy
5,992,652 A 11/1999 Springs
5,992,653 A 11/1999 Anderson et al.
6,041,720 A 3/2000 Hardy
6,082,558 A 7/2000 Battaglia
6,105,791 A 8/2000 Chalson et al.
6,129,218 A 10/2000 Henry et al.
6,142,317 A 11/2000 Merl
6,155,437 A 12/2000 Rassent
6,168,032 B1 1/2001 Merl
6,290,077 B2 9/2001 Sosso
6,311,852 B1 11/2001 Ireland
6,357,606 B1 * 3/2002 Henry ..... 211/59.3
6,375,015 B1 4/2002 Wingate
6,382,431 B1 5/2002 Burke
6,409,028 B2 6/2002 Nickerson
6,464,089 B1 10/2002 Rankin, VI
6,484,891 B2 11/2002 Burke
6,523,703 B1 2/2003 Robertson
6,571,498 B1 6/2003 Cyrluk
6,585,120 B2 7/2003 Robertson
6,622,874 B1 9/2003 Hawkinson
6,666,533 B1 * 12/2003 Stavros ..... 312/348.3
6,691,891 B2 * 2/2004 Maldonado ..... 221/279
6,719,151 B2 * 4/2004 Close ..... 211/59.3
6,719,152 B1 4/2004 Nagel et al.
6,823,997 B2 11/2004 Lindén et al.
2002/0170866 A1 11/2002 Johnson et al.
2003/0085187 A1 5/2003 Johnson et al.
2003/0217980 A1 11/2003 Johnson et al.

* cited by examiner

MERCHANDISING SYSTEM

CROSS-REFERENCE TO RELATED PATENT APPLICATIONS

The present application claims the benefit of priority as may be available under 35 U.S.C. §§ 119–121 from the following application: U.S. patent application Ser. No. 60/408,752 ("MERCHANDISING SYSTEM") filed Sep. 6, 2002 (incorporated herein by reference).

BACKGROUND

The present invention relates generally to the field of merchandising systems. In particular, the present invention relates to merchandising systems providing for orderly presentation of articles (such as products) in a display space.

It is known to provide for a merchandising system that may be used for displaying articles in consumer settings such as grocery stores, retail outlets, shops, etc. Such known merchandising systems may be used to present, display and store articles in fixed or limited spaces such as on shelves, in display cases, cabinets, etc.

It is beneficial when merchandising articles to allow potential customers to view or handle them in a convenient and comfortable manner. It is also beneficial to be able to stock the optimum (e.g., maximum) number of articles within a given shelving display system. However, within fixed or limited spaces, known merchandising systems may not be configured to allow for an optimized number of articles to be presented to a customer. Such known merchandising systems do not always work interchangeably with shelving displays having conventional depths and those with larger depths without limiting the increased storage potential of the larger shelving display systems. For example, some known merchandising systems do not provide an enlargeable space for extending articles beyond the depth of a base of the merchandising system. This added space and adjustability can be an important feature for customers and store personnel because it enables more articles to be merchandised on larger shelving displays.

Accordingly, it would be advantageous to provide a merchandising system that may be dimensioned for use with a shelving display system having a standard depth, but that may also be used interchangeably with a shelving display system having a larger standard depth without limiting the increased storage potential of the larger shelving display system by providing an enlargeable storage space. It would also be advantageous to provide a merchandising system that may provide storage space or an enlargeable space in which articles or products may be stored or presented. It would also be advantageous to provide a merchandising system that may provide a storage space that extends beyond the depth of a base of the merchandising system. It would also be advantageous to provide a merchandising system that may be configured to eliminate a rear wall of the merchandising system and reduce the frequency that a merchandising system be reloaded or restocked with articles. It would also be advantageous to provide a merchandising system that may provide for the selective modularity in the construction and assembly of the merchandising system.

It would be advantageous to provide a merchandising system or the like of a type disclosed in the present application that provides any one or more of these or other advantageous features.

SUMMARY

The present invention relates to a merchandising system for presenting and storing articles comprising a base having a front and a back, the base being configured to support the articles and defining a first space for containing the articles. In addition, the merchandising system comprises an assembly coupled to the base for advancing the articles toward the front of the base wherein the assembly comprises a member configured to extend beyond the base to create a second space for containing the articles in addition to the first space.

The present invention also relates to a merchandising system for presenting and storing articles comprising a support assembly having a front and a back, the support assembly being configured to support the articles in a substantially vertical orientation. In addition, the merchandising system comprises a member movably engaged with the support assembly and configured to extend beyond the back of the base such that the system may be used with a smaller sized shelving system and a larger sized shelving system without limiting the increased storage potential of the larger sized shelving system.

The present invention further relates to a merchandising system for storing and presenting products on a shelf or display case, the products provided in product cases, the merchandising system comprising a means for supporting the products, a means for advancing the products along a predefined path, and a means for retaining one or more of the products beyond a back portion of the means for supporting the products.

The present invention also relates to a merchandising system for dispensing products comprising a base and a pusher for providing a force on the products wherein the pusher comprises a member capable of extending beyond a back of the base such that one or more of the products may be retained by the system beyond the back of the base.

DETAILED DESCRIPTION OF EXEMPLARY EMBODIMENTS

Figure 1:
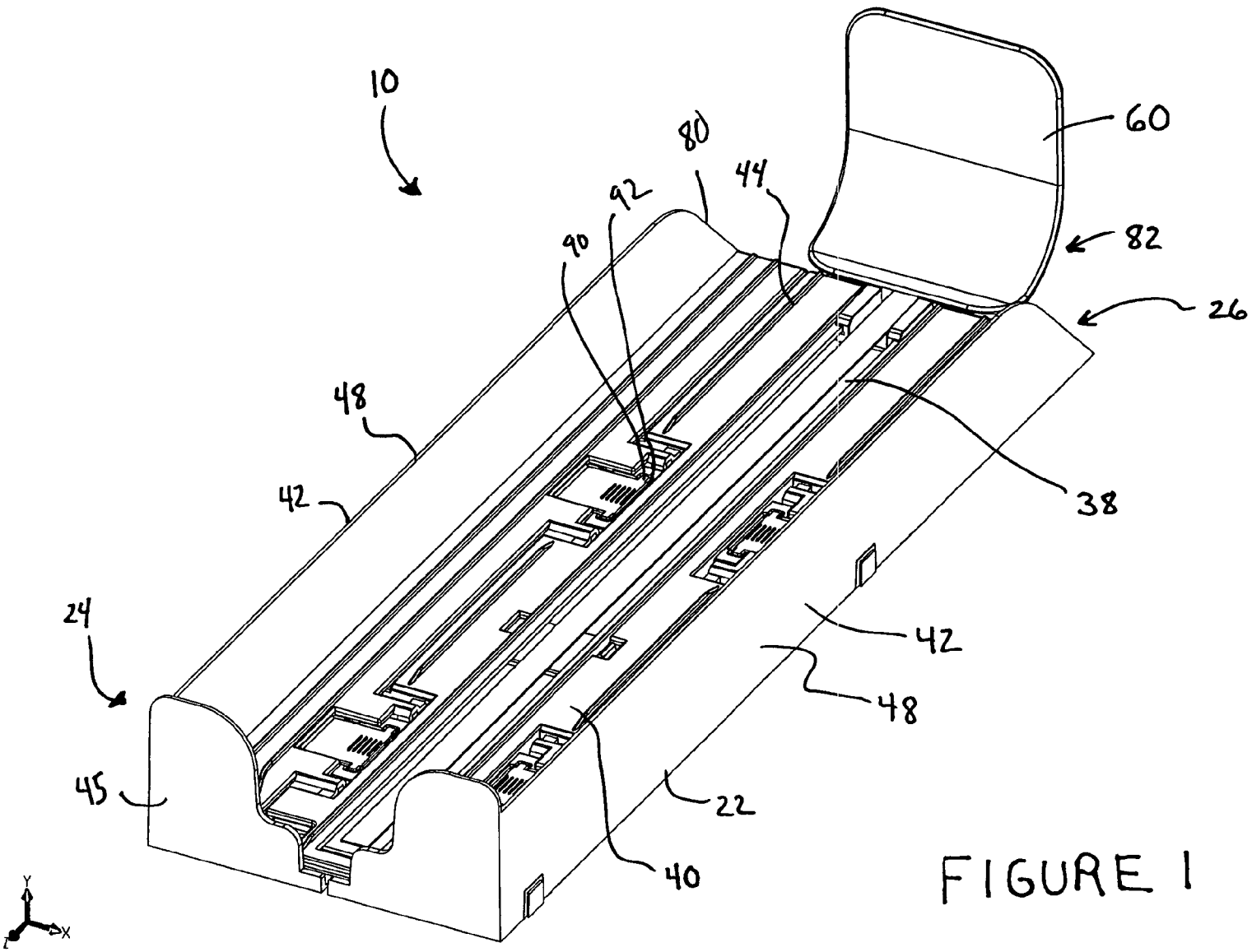
FIG. 1 is a front perspective view of a merchandising system according to an exemplary embodiment.
Figure 2:
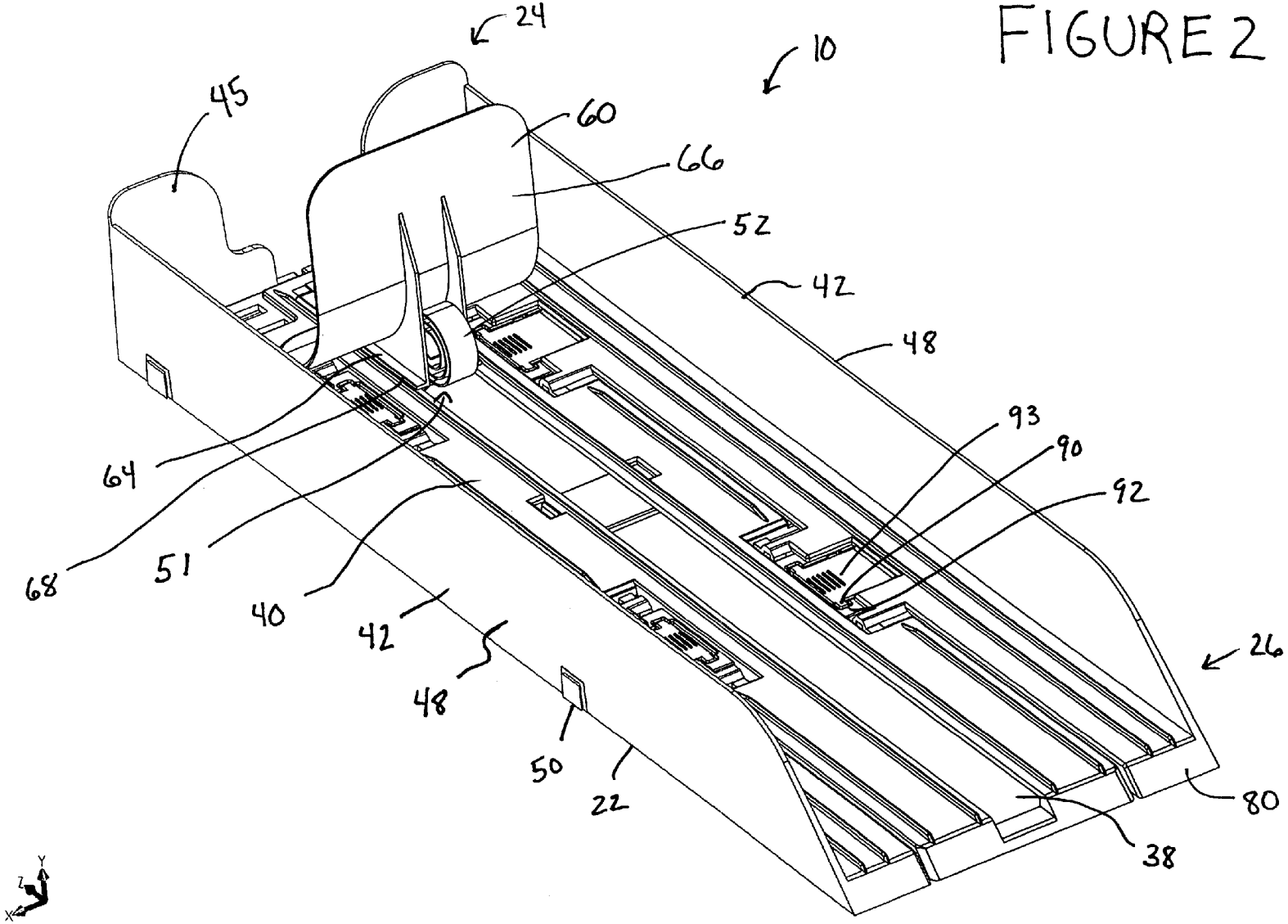
FIG. 2 is rear perspective view of the merchandising system shown in FIG. 1.
Figure 3:
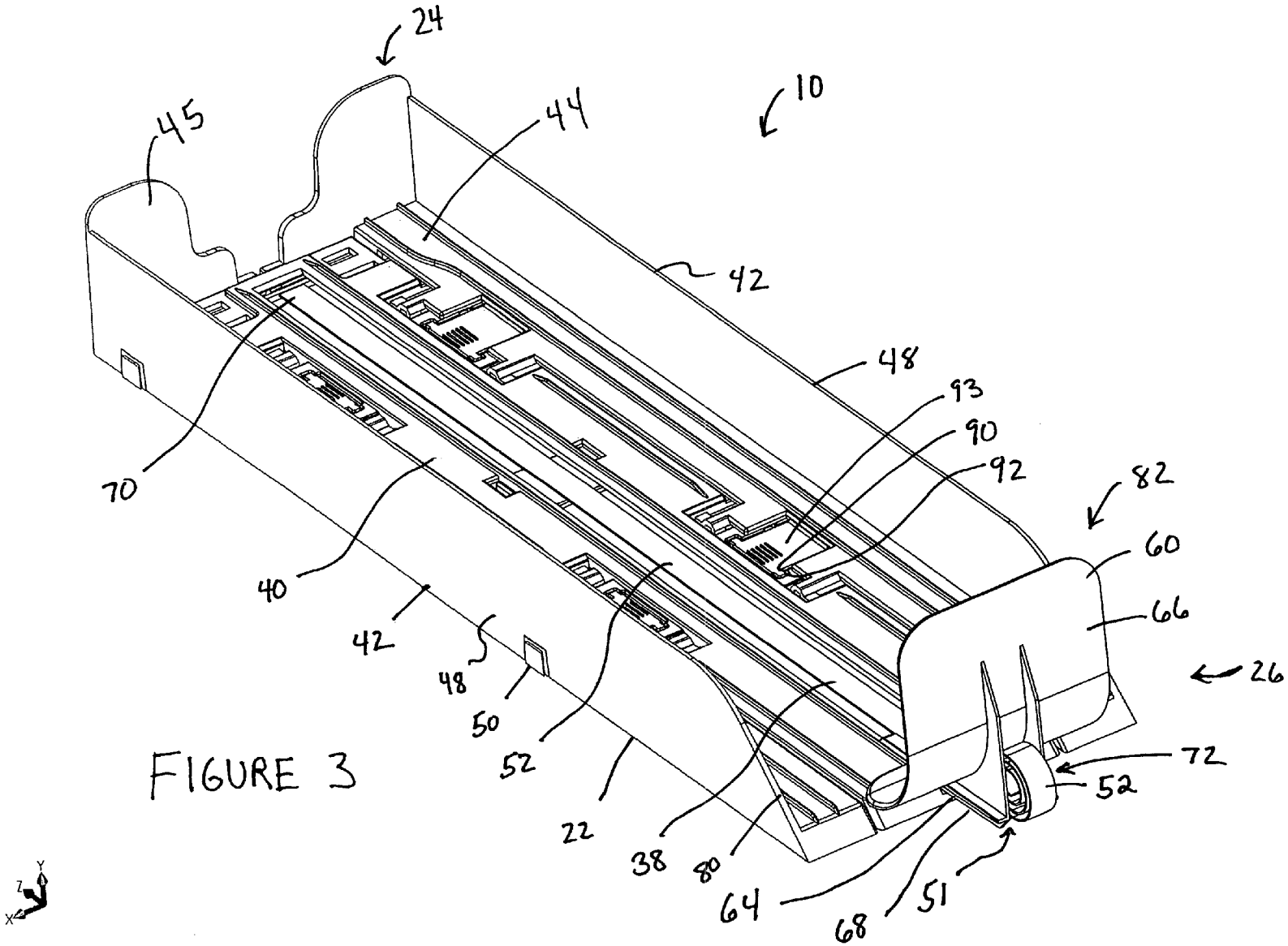
FIG. 3 is a rear perspective view of a merchandising system according to an exemplary embodiment.
Figure 4:
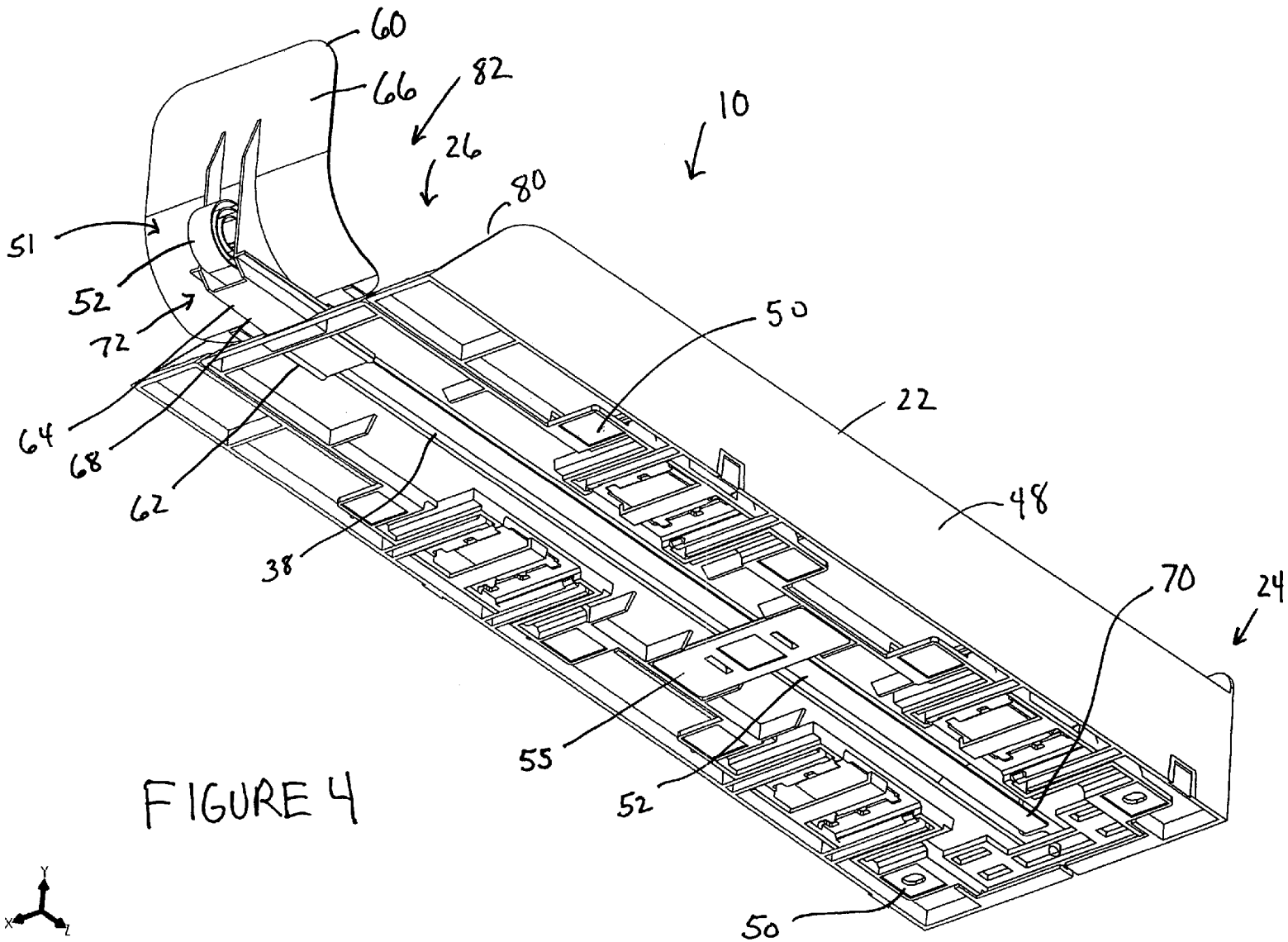
FIG. 4 is a bottom rear perspective view of a merchandising system according to an exemplary embodiment.

Referring to FIGS. 1 through 20, various exemplary and alternative embodiments of a merchandising system intended for displaying articles such as products, containers, items, units, etc. in consumer settings such as grocery stores, retail outlets, shops, etc. are shown. According to a preferred embodiment, the merchandising system is intended to dispense, store, merchandise, display, etc. articles to provide for the space-efficient presentation of groups of articles within a given or fixed display area, and/or to allow for convenient and orderly presentation, dispensing, and storage of articles (such as products or product containers) having any of a wide variety of sizes, shapes, and profiles (e.g., rectangular, non-rectangular, etc.).

FIGS. 1 through 6 show a merchandising system 10 (e.g., tray system, shelf system, display system, case, divider system, storage system, modular system, etc.) according to an exemplary embodiment. Merchandising system 10 may comprise a base 22, a member 60, a biasing mechanism 52, a front wall 46, at least one side member 48 and one or more fasteners 50.

According to an exemplary embodiment, system 10 includes a base 22 (e.g., floor, support, support system, panel, member, platform, tray, etc.) having a front end 24 (e.g., front) and a back end 26 (e.g., rear). As shown in FIGS. 1 through 6, base 22 may be provided in a substantially horizontal orientation. The base 22 may be configured to support articles such as product (e.g., merchandise, foodstuffs, boxes, containers, food products, bottles, cans, etc.). The base 22 may also be provided with one or more apertures (e.g., holes, cutouts, voids, slots, etc.) in the base 22.

According to various exemplary embodiments, one or more base (e.g., tray system) may be provided. The base may be provided on an existing merchandising system such as a shelf, grid system, display case, etc. The base may be configured to hold, display, retain, store, or otherwise receive articles (e.g., goods, displayed objects, etc.). The base provides for the space division and orderly and convenient presentation of such articles.

Base 22 may be configured to connect or couple adjacent systems into a larger overall merchandising system. According to a preferred embodiment, the base 22 has a "modular" construction and facilitates use with other bases, shelves, or a variety of other existing merchandising systems, including shelving units, support surfaces, grids, brackets, hangers, etc. According to an alternative embodiment, the base may include a back wall to further add support for articles contained within a merchandising system. The base may also be provided with one or more apertures (e.g. holes, cutouts, voids, etc.) in the base.

Figure 12:
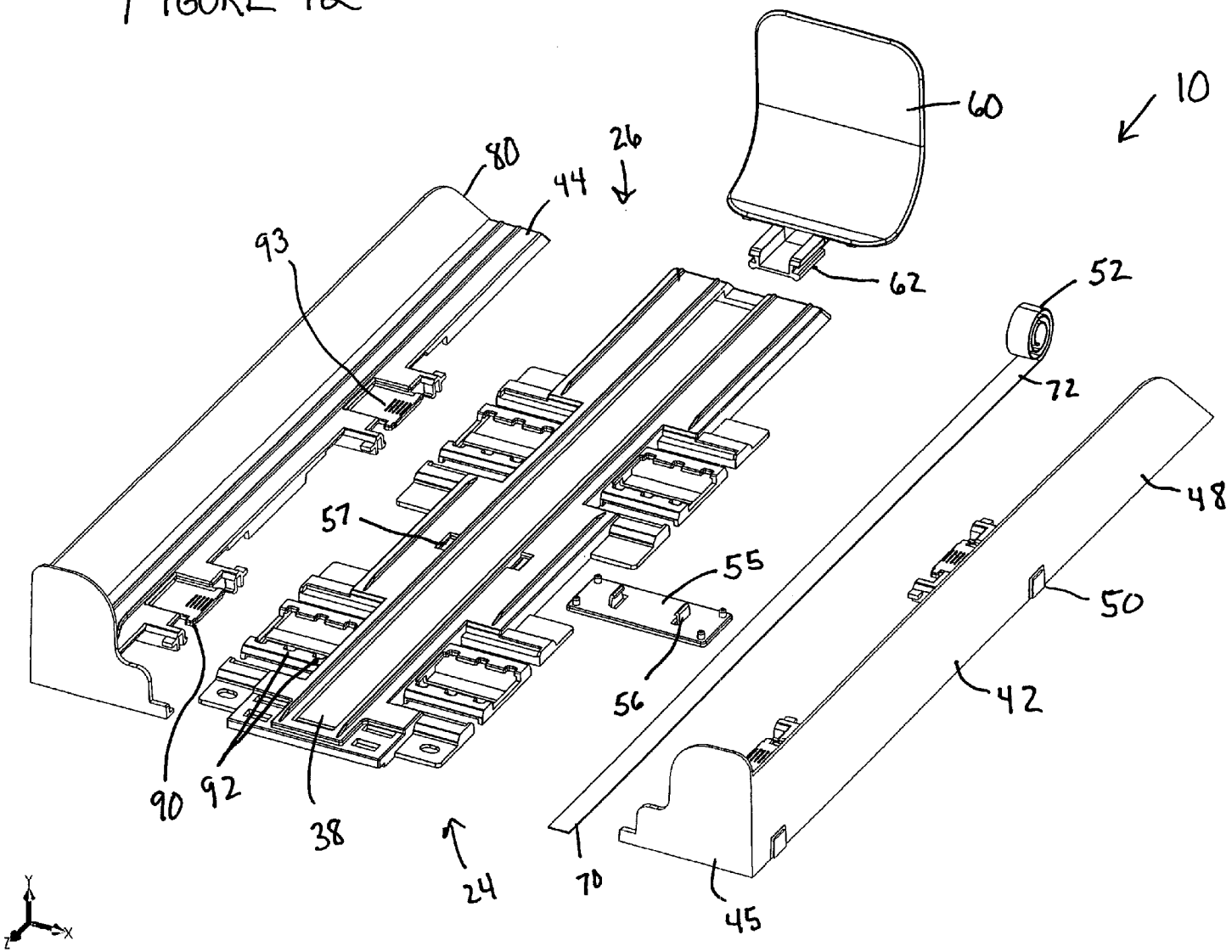
FIG. 12 is an exploded front perspective view of a merchandising system according to an exemplary embodiment.

The base 22 may also be provided with at least one track 38 (e.g. guide, notch, groove, recess, slot, etc.). The track 38 may extend substantially along the length of the base 22. As shown in the FIGS., base 22 may include a support 55 (e.g., bar, clip, fastener, etc.) that adheres to the bottom of the base on both sides of the track 38. According to a preferred embodiment, support 55 is permanently coupled to base 22 to provide support to track 38. For example, as shown in FIG. 12, support 55 may include tabs 56 which "clip" into apertures 57 located on base 22 and an adhesive bond may be applied to keep support 55 "locked" in place. Support 55 helps prevent track 38 from being spread apart too far while member 60 moves along the base 22. According to alternative embodiments, support 55 may be removably coupled to base 22.

According to an exemplary embodiment, the base 22 may be configured with at least one side member 48 and/or a front wall 46. As shown in FIGS. 1 through 6, 12, and 13, base 22 comprises two side members 48 (e.g., divider panels, separators, walls, sides, panels, members, etc.) and a surface 40. According to an alternative embodiment, the base and side element(s) may be assembled and constructed as a single unit (see FIGS. 19 and 20).

Figure 13:
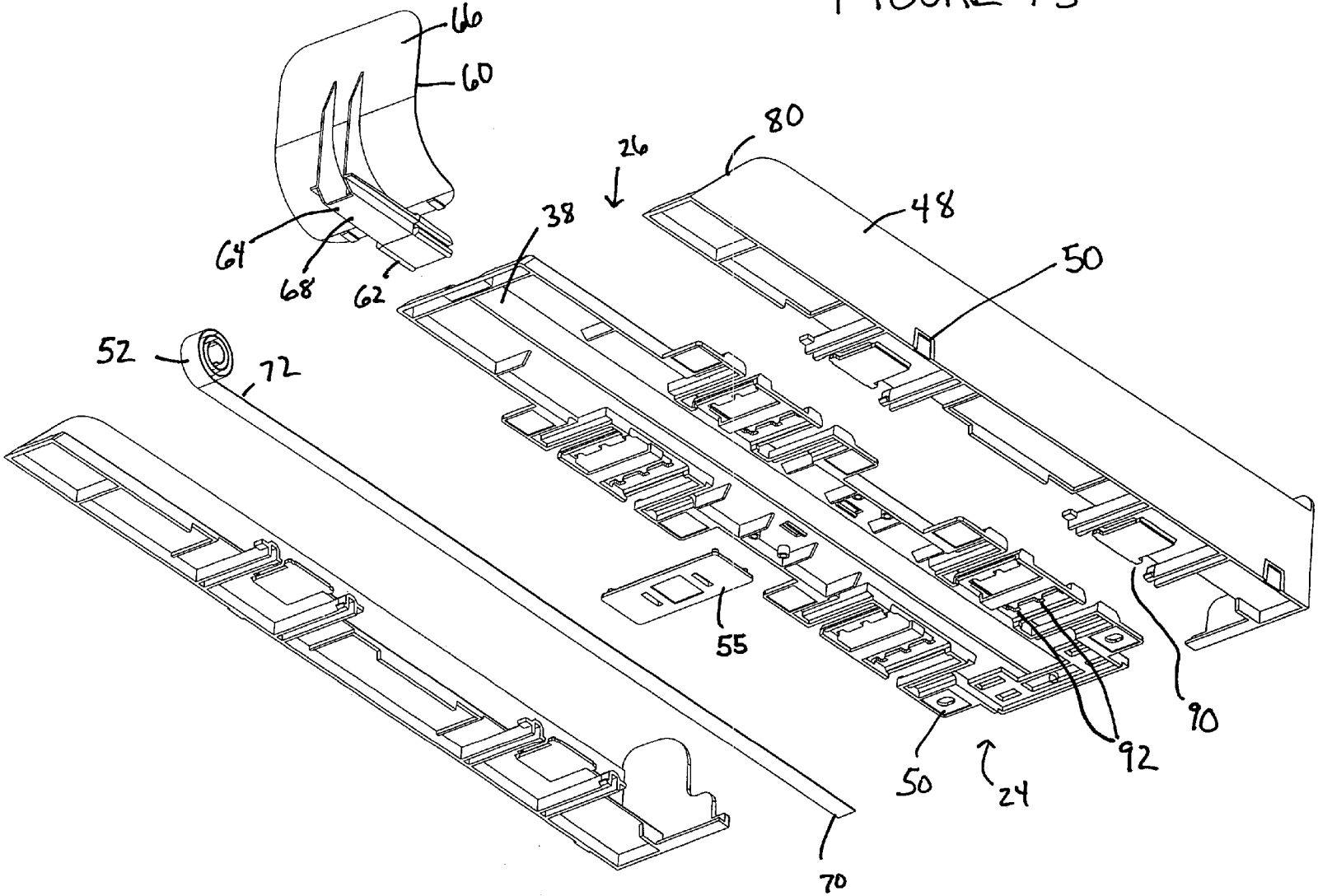
FIG. 13 is an exploded rear perspective view of a merchandising system according to an exemplary embodiment.
Figure 19:
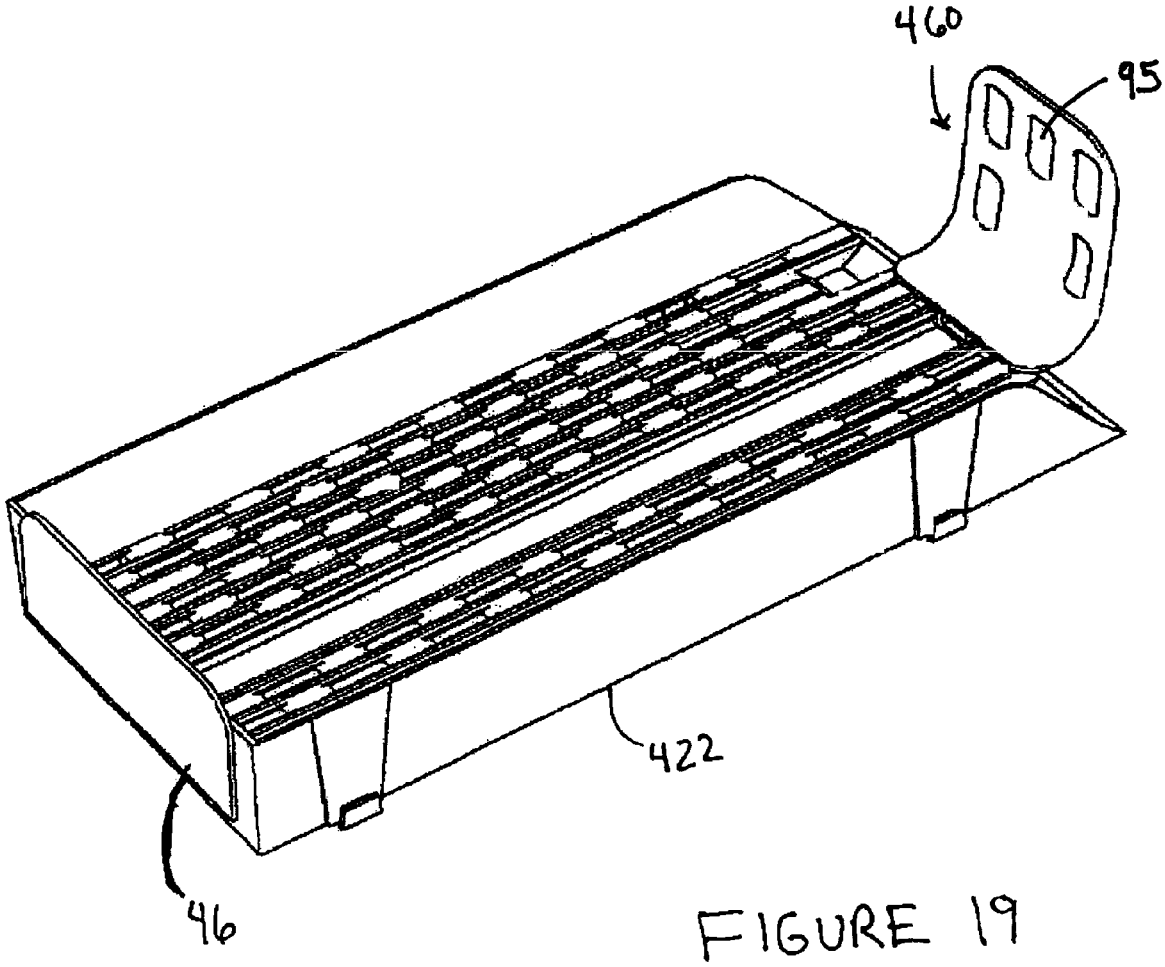
FIG. 19 is a side perspective view of a merchandising system according to an alternative embodiment.
Figure 20:
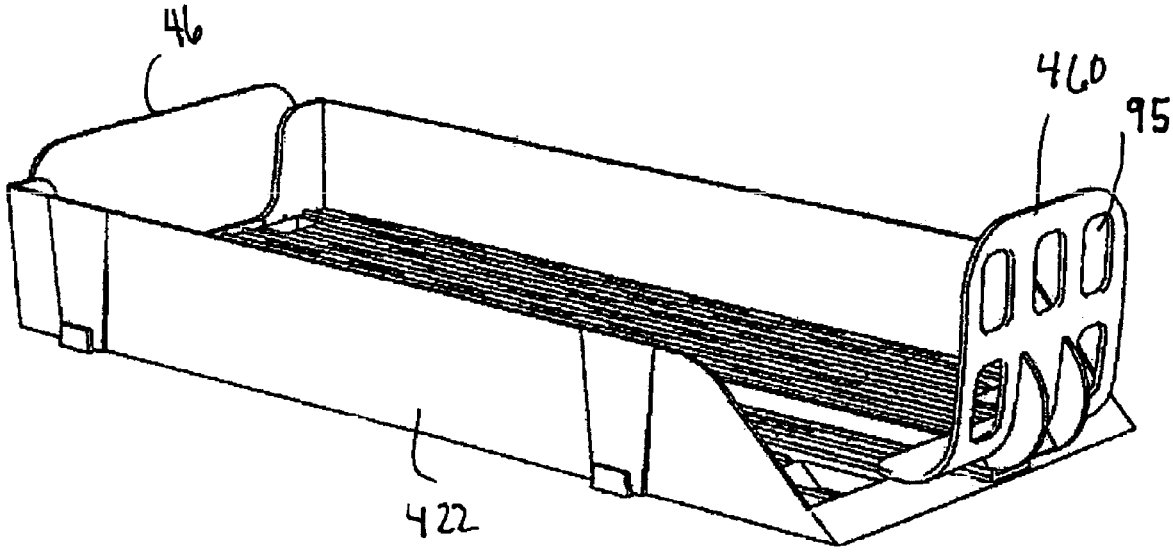
FIG. 20 is a rear perspective view of a merchandising system according to an alternative embodiment.

According to alternative embodiments, the configuration of the base may be altered to better accommodate the shape of the articles (e.g., the base may have a circular, triangular or polygonal cross-section, the base may have a non-uniform configuration throughout, etc.). As shown in FIGS. 12 and 13, the side members 48 may comprise multiple members positioned in multiple orientations or positions. The side member 48 may have a first member 42 provided in a substantially vertical orientation. The first member 42 may extend substantially the length of the base 22. The first member 42 may function as a side wall and define the sides of the space in which articles are merchandised or stored. The side member 48 is not limited to the first member 42 positioned along the side edges of the base 22 and may include members that function similarly to both the base 22 and the front wall 46, as shown in FIGS. 19 and 20, of the merchandising system 10. The side member 48 may be configured so that a second member 44 of the side member 48 may be provided in a substantially horizontal direction, on substantially the same plane as the surface of the base 22, and configured to support articles. The second member 44 may be configured to function similarly to the base 22. The side member 48 may also be configured so that a third member 45 of the side member 48 may be provided in a substantially vertical orientation and perpendicular to the first member 42 of the side member 48. The third member 45 may be configured to function similarly to the front wall 46 of the merchandising system 10 and may prevent the articles from falling off the front edge of the base 22. In an alternative embodiment, the front wall may be eliminated with the third member 45 sufficiently retaining the articles as force is applied by the member 60.

As shown in FIGS. 1 through 6, the side members 48 may be configured to selectively engage with the base 22. The side member 48 may be configured with a plurality of members 90 (e.g. fingers, male connectors, etc.) and apertures 92 (e.g. slots, female connectors, etc.) that correspond with the similar structures of the base 22 to engage the side members 48 with the base 22. As shown in FIGS. 1 through 3, 7, and 12, the engagement between the side members 48 and the base 22 may provide for the selective adjustment of the width of the merchandising system 10. In a preferred embodiment, the side members 48 may be selectively released from the base 22 by means of a "push button," (shown as button 93 in the FIGURES) and the width of the merchandising system 10 may be adjusted by sliding the side members 48. According to an alternative embodiment, the "push button" may be replaced with any element (e.g., latch, hook, etc.) configured to selectively release the side members 48 from the base 22.

The side members 48 may be spaced in a substantially contracted position to accommodate a narrower article or product. Alternatively, the side members 48 may be spaced in a substantially expanded position to accommodate a wider article or product. Whether spaced in a substantially contracted position or a substantially expanded position, the side members 48 may remain selectively engaged to the base 22.

According to an exemplary embodiment, system 10 includes member 60 (e.g., paddle, movable panel, scoop, pusher, plate, follower, etc.) that is slidably engaged to the base 22. As shown in FIGS. 1, 2, 4, 5, 6, 9, 10, 11, 14 and 15, the member 60 is slidably engaged to the track 38 of the base 22. According to an exemplary embodiment, the member 60 may be constructed as a single unit. In an alternative embodiment, the member 60 may be provided as an assembly of two or more elements.

Figure 14:
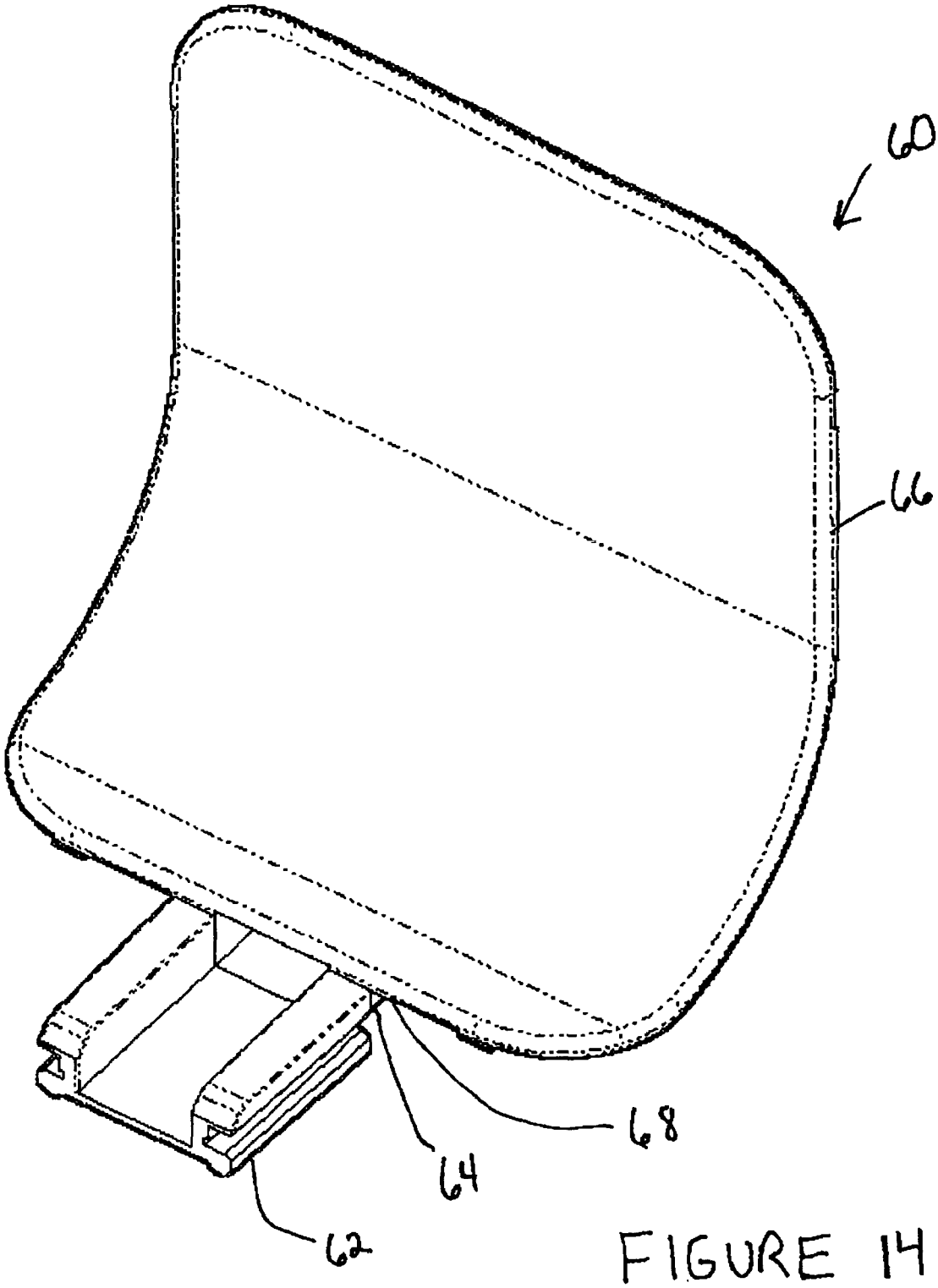
FIG. 14 is a front perspective view of a member for use with a merchandising system according to an exemplary embodiment.
Figure 15:
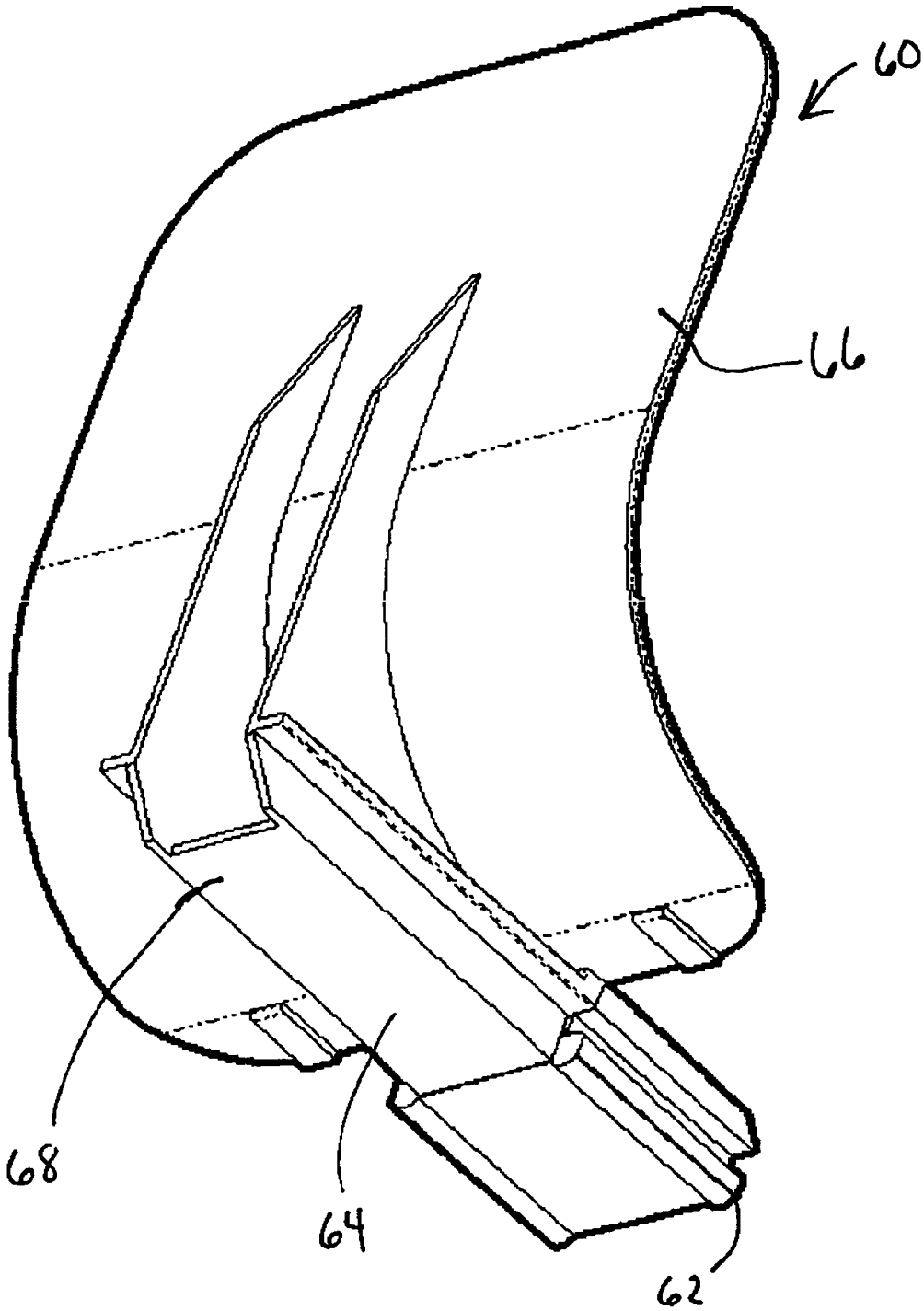
FIG. 15 is a back perspective view of a member for use with a merchandising system according to an exemplary embodiment.

As shown in FIGS. 14 and 15, the member 60 includes a back portion 66 that is provided in a substantially vertical orientation and a base portion 68 that is provided in a substantially horizontal orientation. As shown in FIGS. 14 and 15, the back portion 66 is positioned perpendicular to the base portion 68 to form a substantially L-shaped configuration. The back portion 66, as shown in FIGS. 14 and 15, may be rectangular in shape. According to alternative embodiments, the back portion may be circular, scoop-shaped, triangular, trapezoidal, fork-shaped, etc. The base portion 68 may be configured to slidably engage with the base 22. For example, the base portion 68 may be configured to slidably engage with the track 38 extending substantially the length of the base 22. The base portion 68 may be configured to support articles such as product. The base portion 68 may also be configured to interact with a biasing mechanism 52. In some embodiments, the shape of the base portion 68 of the member 60 may be fork-shaped. In other embodiments, the shape of the base portion 68 may be rectangular, scoop-shaped, circular, triangular, trapezoidal, etc.

Base portion 68 may be provided with tabs 62 (e.g., projections, pegs, etc.) which may be configured to coact or engage with the track 38 of the base 22. The member 60 may also be configured with a platform 64 (tab, ledge, member, shelf, etc.) that may provide support for the biasing mechanism 52. The platform 64 may also guide the biasing mechanism 52 during the movement of the member 60.

According to various alternative embodiments, the member may have a wide variety of shapes and/or configurations which provide for an extended, enlarged or enlargeable space (e.g., area, volume, etc.). As shown in FIGS. 14 and 15, the member 60 may have a curved shape (e.g., curved, scoop, shovel-like, cup-like, bucket-like, etc.). Providing a member 60 with a curved shape may better accommodate certain shapes of articles. For example, the curved shape may better accommodate a bag of articles (such as chips, salty-snacks, etc.) while a member of another shape (e.g., rectangular) may better accommodate a more fixed or rigid article (such as boxed products, etc.).

Figure 16:
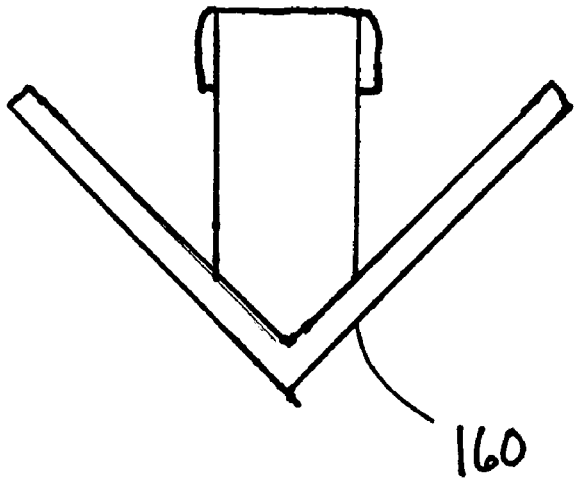
FIG. 16 is a schematic top plan view of a member for use with a merchandising system according to an alternative embodiment.
Figure 17:
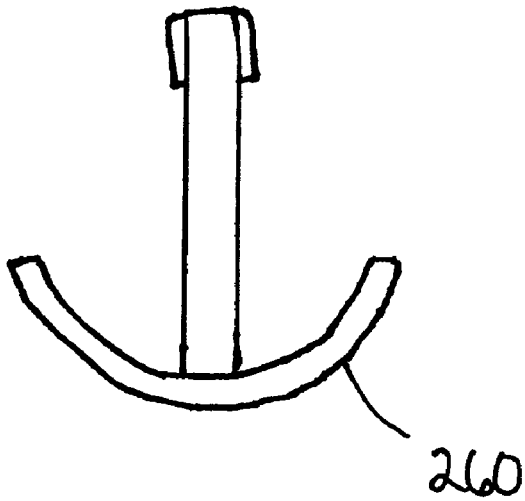
FIG. 17 is a schematic top plan view of a member for use with a merchandising system according to an alternative embodiment.
Figure 18:
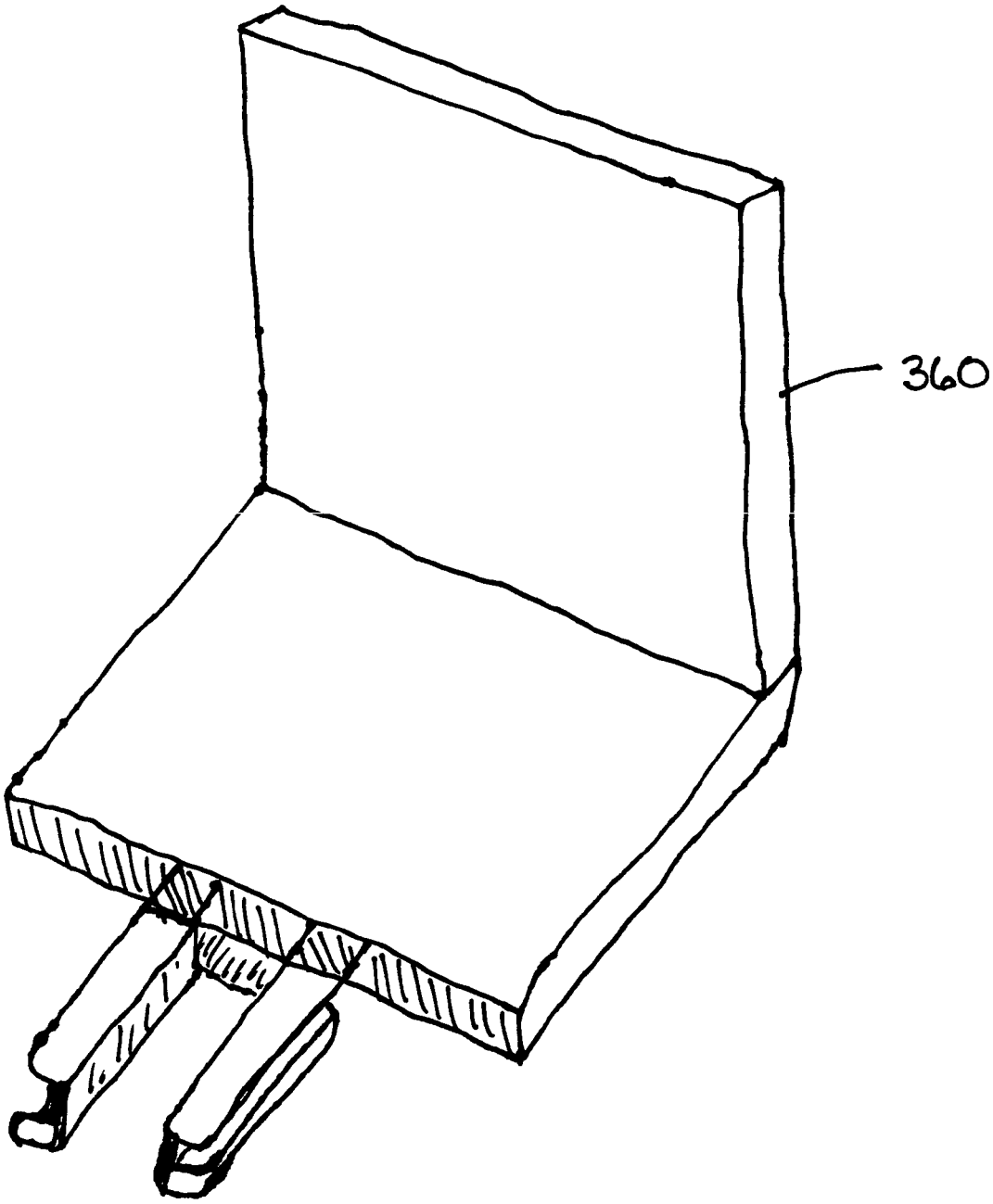
FIG. 18 is a schematic side perspective view of a member for use with a merchandising system according to an alternative embodiment.

According to other alternative embodiments, the member (e.g., pusher) may have a wide variety of shapes and configurations, including angular shapes or curved shapes (as shown in FIGS. 16, 17, and 18). The shape of the member may be varied to better accommodate the shape of an article (e.g., member 160 shown in FIG. 16, member 260 shown in FIG. 17, and member 360 shown in FIG. 17).

According to an alternative embodiment shown in FIGS. 19 and 20, a member 460 located on a base 422 may be provided with one or more apertures 95 (e.g., cut-outs, reliefs, holes, etc.). The one or more apertures 95 may advantageously reduce the amount of material needed to build and/or construct the member 460, or alternatively reduce the weight of the member 460.

As best shown in FIGS. 7 through 11, system 10 includes an assembly 51 for advancing articles toward the front end 24 of the base 22. Assembly 51 may include a biasing mechanism 52 (e.g., spring, coil spring, helical spring, elastic, etc.) to urge or bias the member 60. As shown in FIGS. 7 through 11, the biasing mechanism 52 may be a coil spring with a first end 70 attached to the front end 24 of the base 22 and a second end 72 coacting with the member 60. When the member 60 is near the front end 24 of the base 22, the spring is at least partially relaxed. As the member 60 is moved away from the front end 24 of the base 22, the tension in the spring is increased.

According to an alternative embodiment, the coil spring shown in FIGS. 2, 7, 11 and 13 can be replaced with any other biasing mechanism. In alternative embodiments, the biasing mechanism may be, but is not limited to, a spring, helical spring, elastic, etc.

Figure 5:
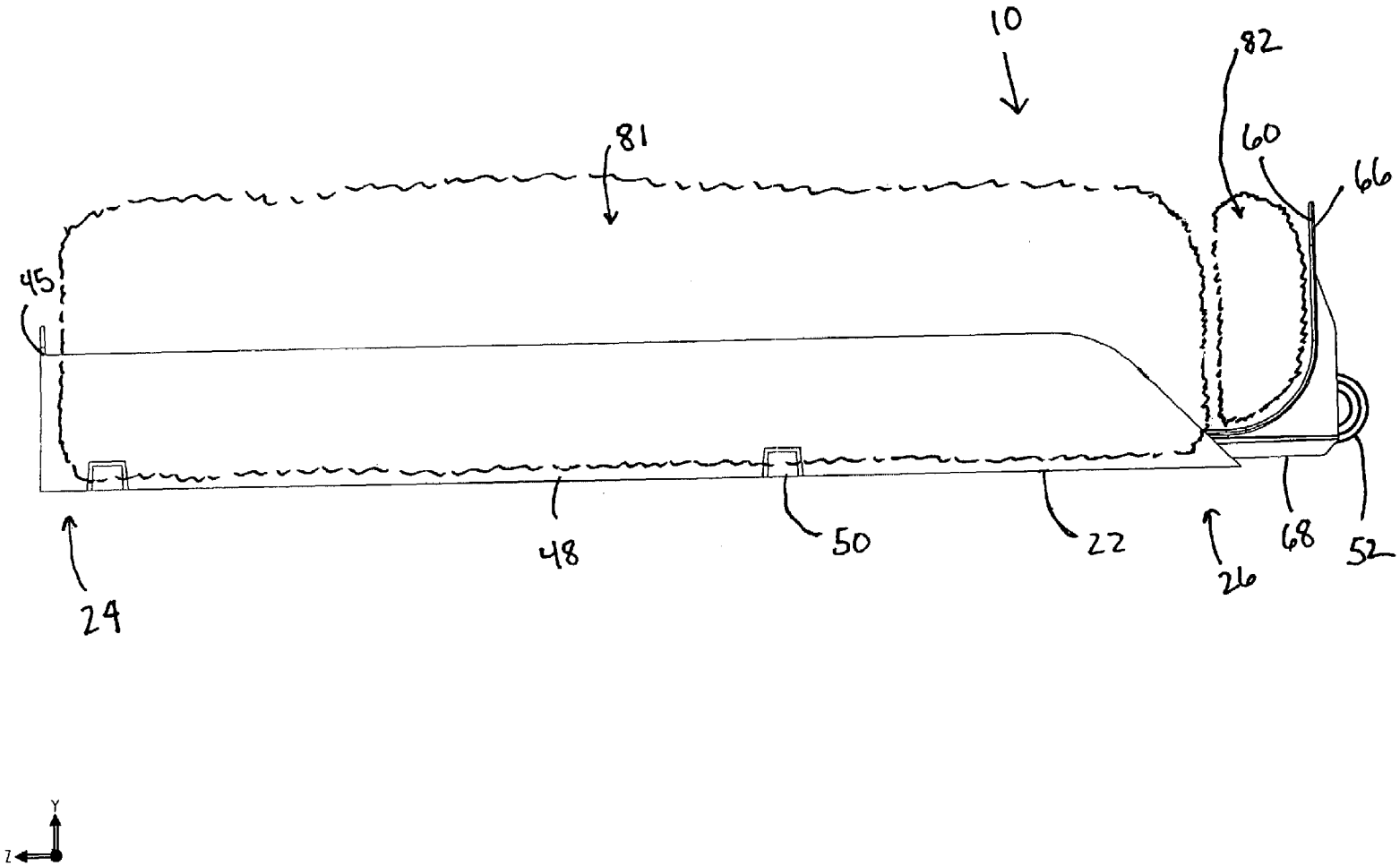
FIG. 5 is a side view of a merchandising system according to an exemplary embodiment.
Figure 6:
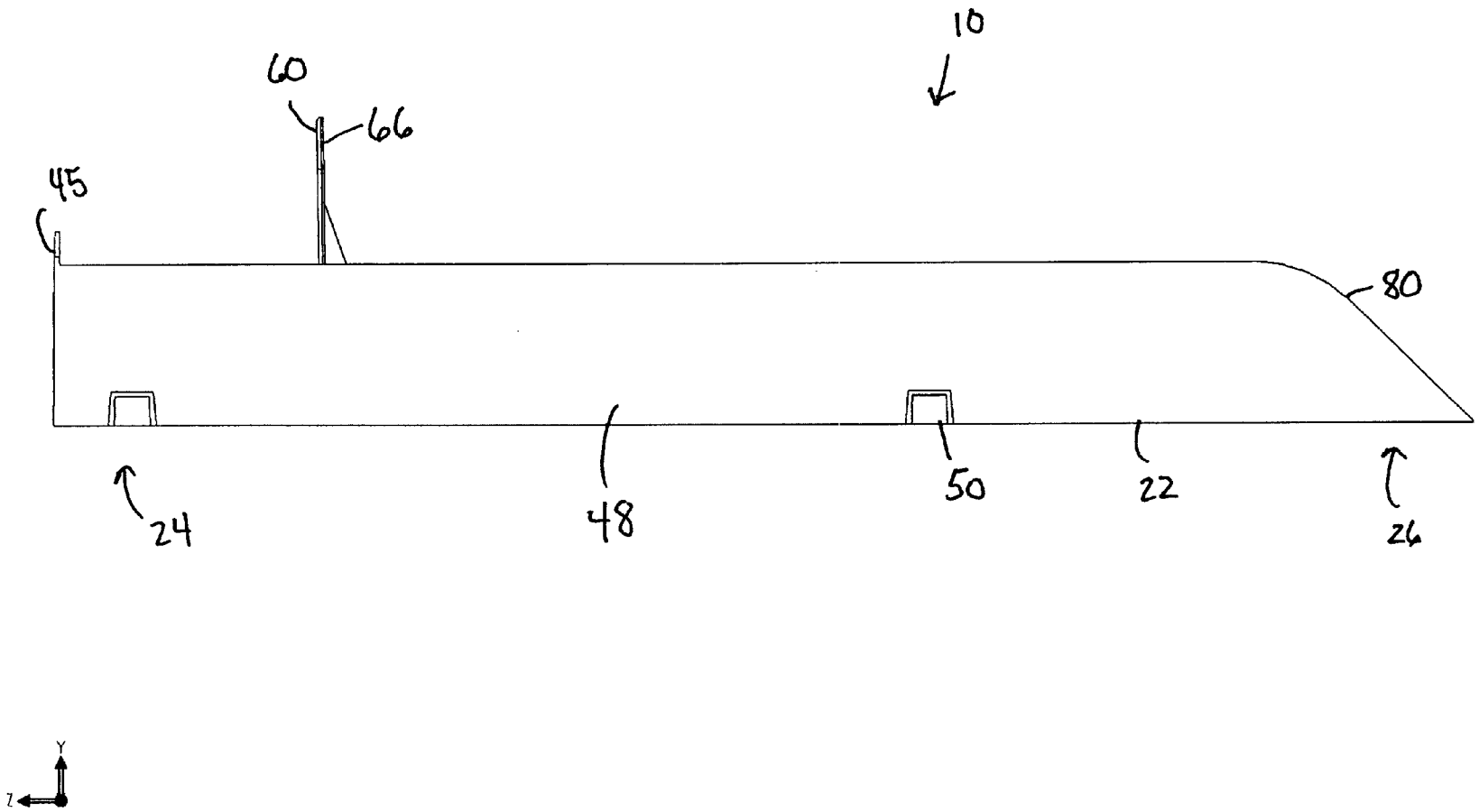
FIG. 6 is a side view of a merchandising system according to an exemplary embodiment.
Figure 7:
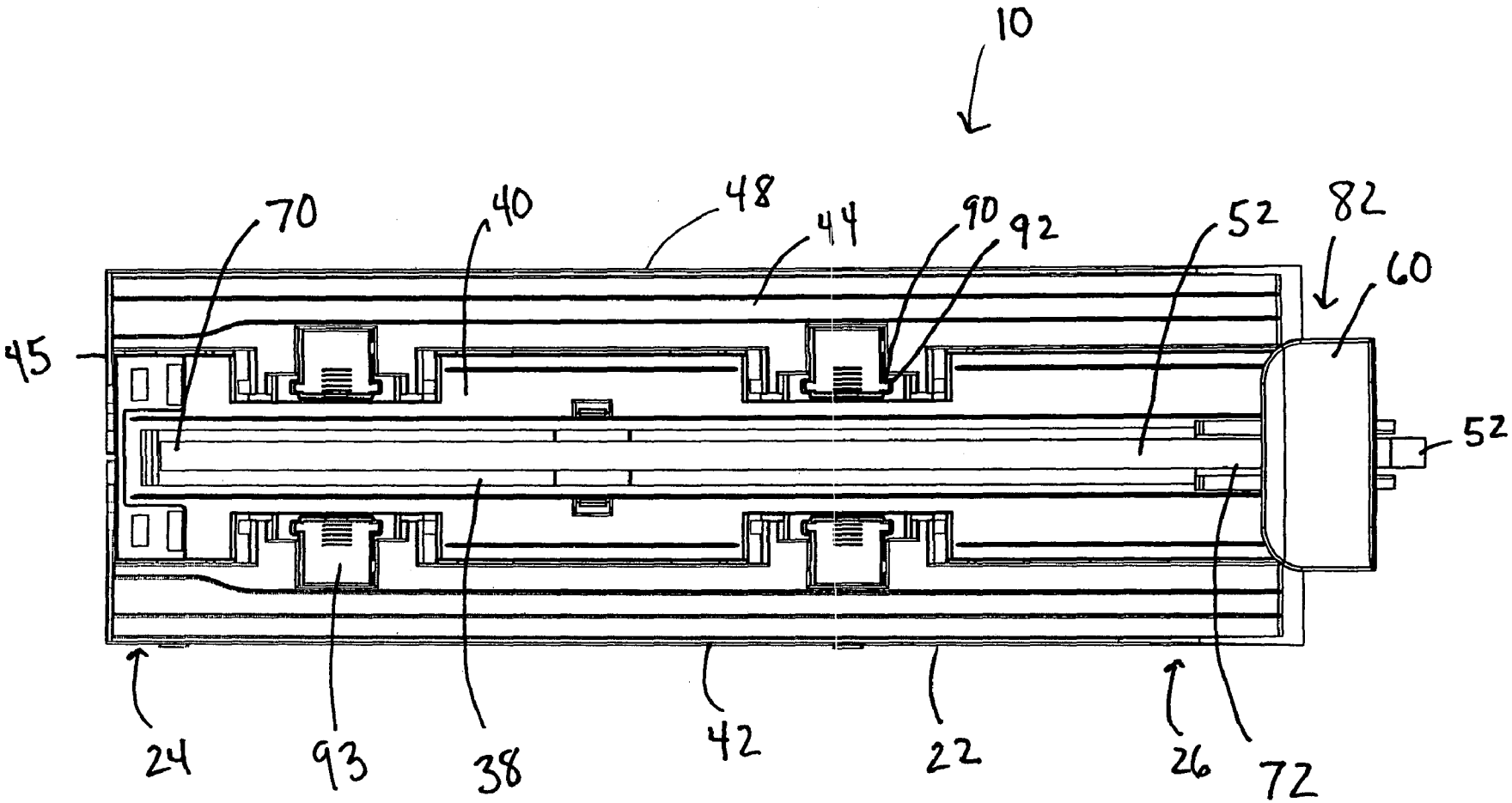
FIG. 7 is a top plan view of a merchandising system according to an exemplary embodiment.
Figure 8:
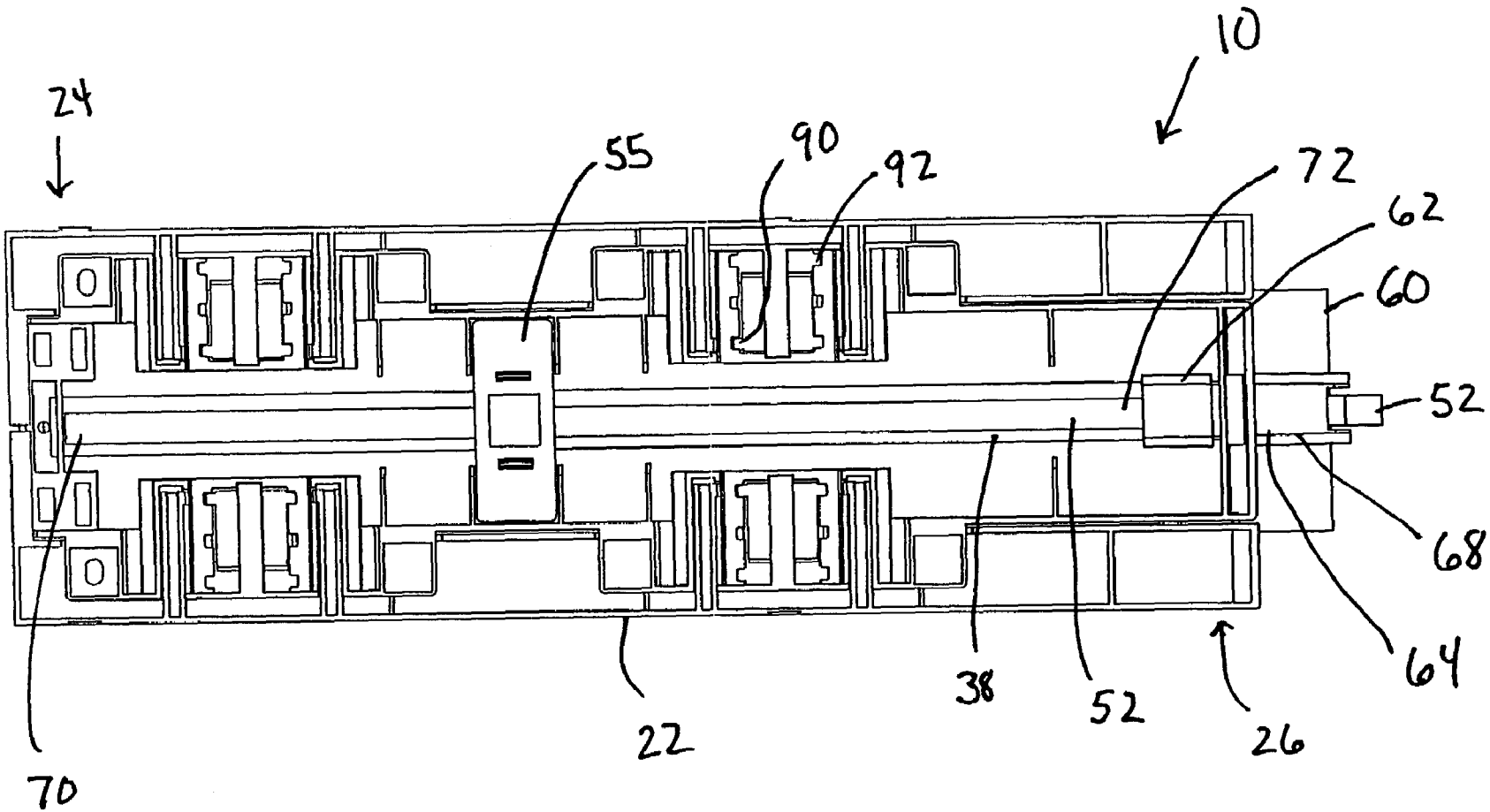
FIG. 8 is a bottom plan view of a merchandising system according to an exemplary embodiment.
Figure 9:
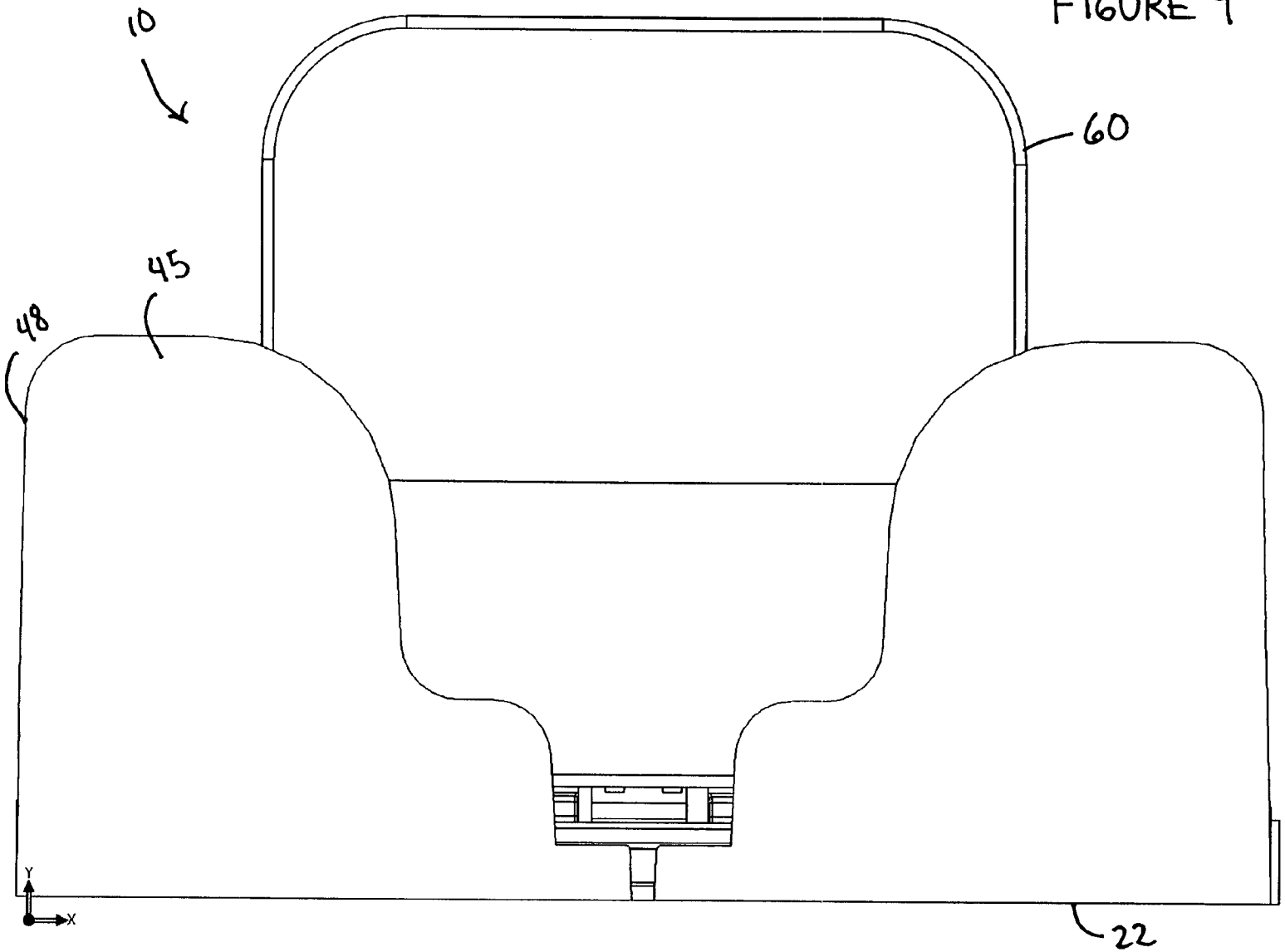
FIG. 9 is a front view of a merchandising system according to an exemplary embodiment.
Figure 10:
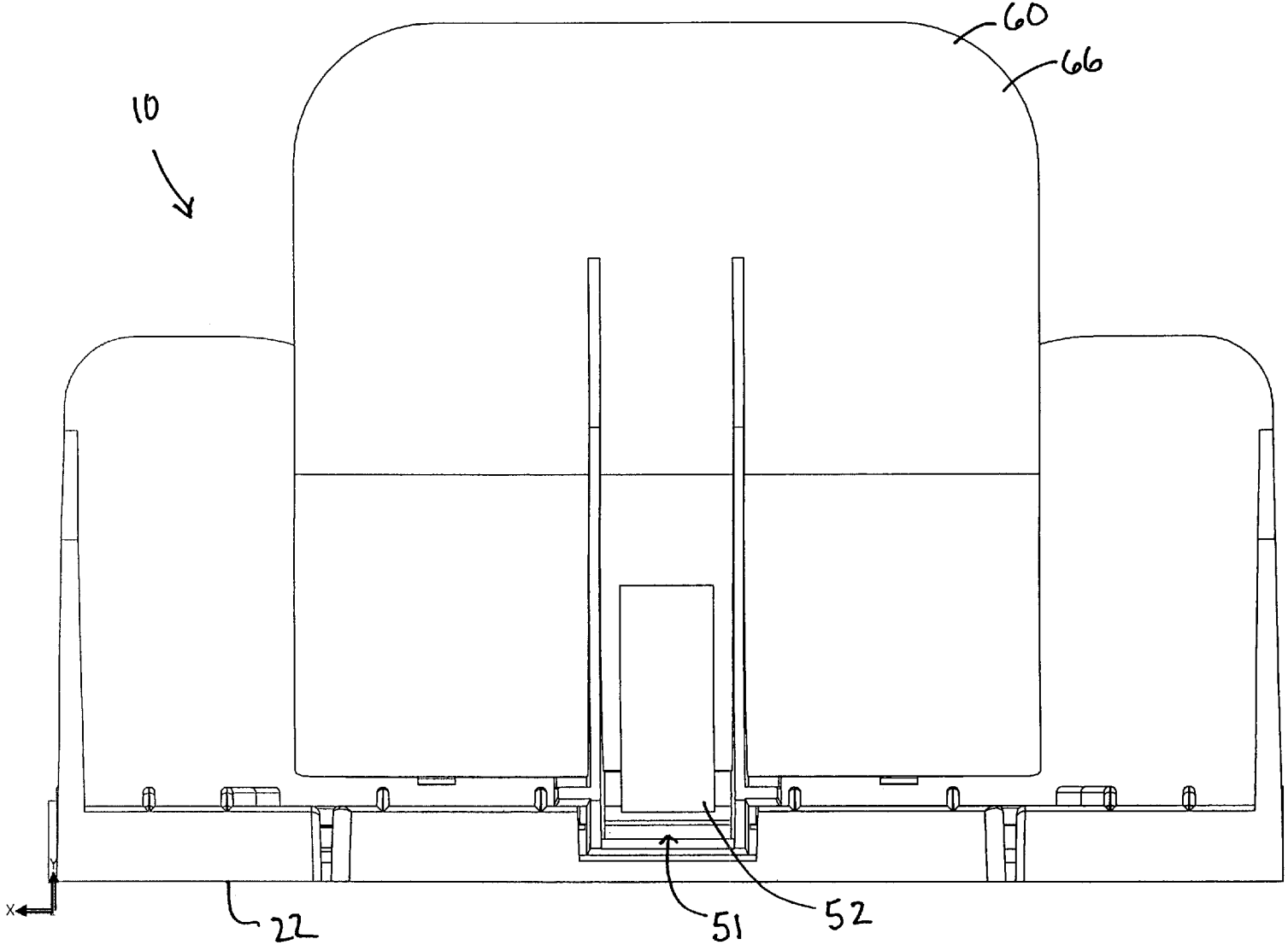
FIG. 10 is a rear view of a merchandising system according to an exemplary embodiment.
Figure 11:
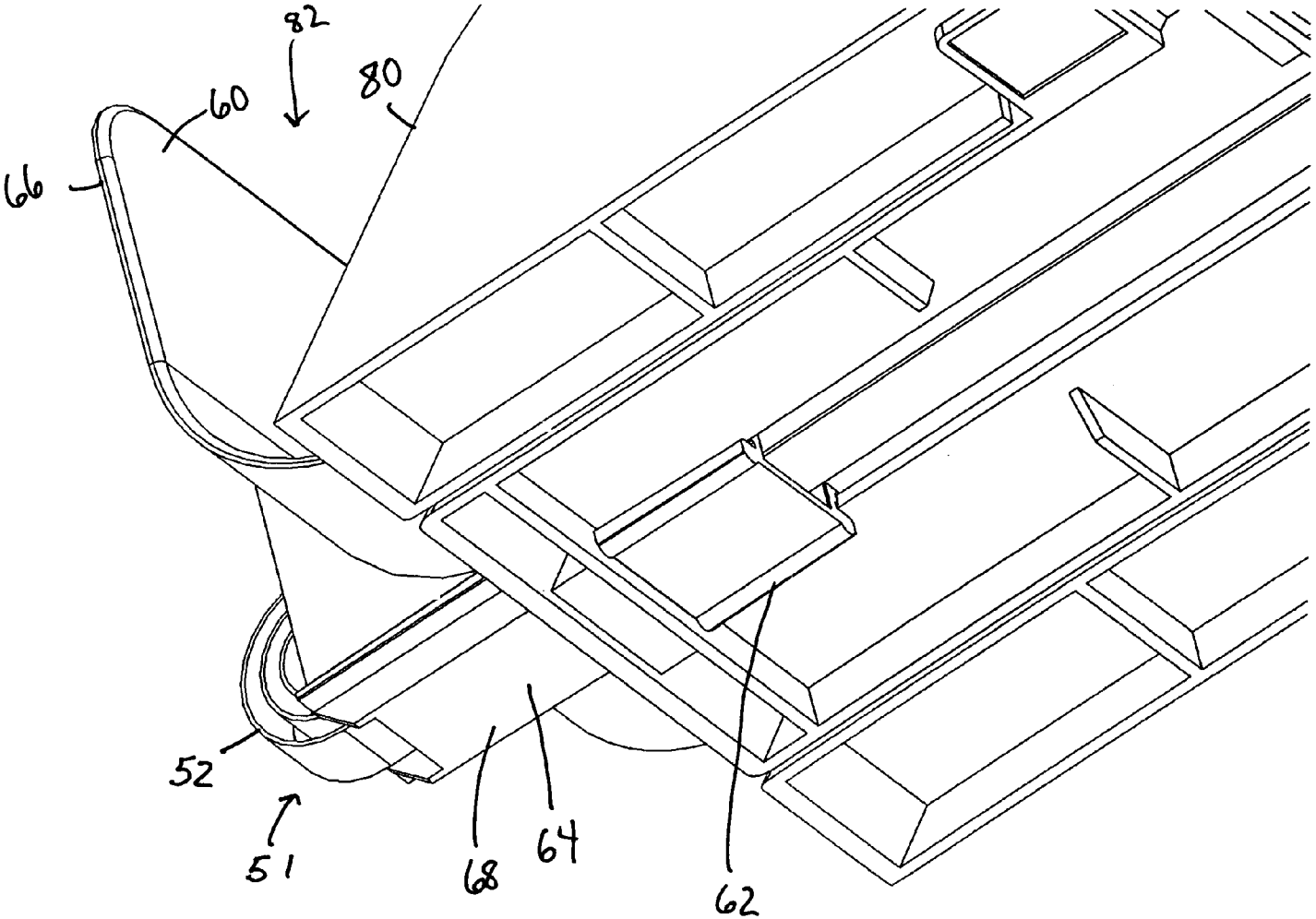
FIG. 11 is a partial view of a member and biasing mechanism for use with a merchandising system.

As shown in FIG. 5, system 10 includes a first space 81 and a second space 82. According to an exemplary embodiment, first space 81 is defined by base 22 (e.g., first member 42, second member 44, and third member 45, etc.) and member 60 located at the back of the base 22. As shown in FIG. 5, the back of the first space 81 is located along the back edge of base 22. Second space 82 is defined by the end of the first space 81 along the back edge of base 22, and the member 60 extended beyond the back of the base 22 (e.g., this depends on the configuration of member 60 and how much member 60 is extended beyond the back of base 22).

According to exemplary embodiments, as shown in FIGS. 1 through 6, base 22 may comprise angled surfaces 80 (e.g., edges) along the back end of base 22. The angled surfaces 80 allow articles to be pushed by member 60 out of the second space 82 (e.g., area, volume, etc.) shown in FIG. 5 with minimal interference from base 22. Articles are less likely to get "caught" on the edges of base 22 with smoother or beveled edges along the back end of base 22.

As shown in FIGS. 19 and 20, a front wall 46 (e.g., panel, member, plate, lens, window, etc.) may be provided along the front end 24 of a base (shown as base 422). The front wall 46 may be provided in a substantially vertical orientation.

According to one exemplary embodiment, the front wall may be a separate member which attaches to the merchandising system. As shown in FIGS. 19 and 20, the front wall 46 is configured to selectively engage with a portion of the merchandising system (shown as engaging portions on the side member and the base). According to a particularly preferred embodiment, the front wall 46 engages with the corresponding portions of the merchandising system by a "snap fit." As shown in FIGS. 19 and 20, the front wall 46 may be a rectangular shape and may be of a length to substantially extend from one side member to the other side member. Alternatively, the front wall 46 may be circular, octagonal, trapezoidal, etc. in shape and may be of any size or configuration sufficient to retain the article as a force is being applied to the article by the member. According to alternative embodiments, the front wall may be an integral piece with the base and/or side member(s).

The front wall 46 may be configured to receive or display indicia (e.g. text, graphics, display placards, signage, etc.). For example, indicia may be applied directly to the front wall 46. Alternatively, the front wall 46 comprises one or more channels configured to hold and display indicia. Additionally, the front wall may be clear to increase visibility of the merchandising articles. This configuration allows the articles to be readily visible by minimizing the potential obstruction that could be created by a front wall. According to an exemplary embodiment, the visibility of the articles may be maximized by providing a clear or transparent front wall.

According to an exemplary embodiment, one or more fasteners 50 (e.g., mechanical fasteners, adhesives, suction cups, rubber feet, bolts, Velcro™, brackets, etc.) may be provided on the merchandising system 10 to hold, retain, etc. the merchandising system 10 in place. According to a particularly preferred embodiment as shown in FIGS. 2 through 6 and 13, the fasteners 50 may be non-skid rubber feet provided on the underside of the merchandising system 10. Slots may be provided on the underside of the merchandising system 10 to receive the non-skid rubber feet. The non-skid rubber feet may adhere or otherwise coact with a surface (such as a display shelf). According to alternative embodiments, fasteners may be omitted.

According to various exemplary embodiments, the assemblies and components of the merchandising system 10 may be constructed from extruded or injection molded plastic. A variety of plastics may be used for construction or assembly. For example, the member(s) may be constructed or assembled from high-impact plastics, polymers, etc. Using plastic offers several advantages including that the pieces may be constructed in a variety of different colors, surface finishes, textures, opacity, etc. According to various alternative embodiments, a variety of other known or suitable materials may be used, including metals, alloys, composites, etc.

According to the various exemplary embodiments shown in the FIGURES, a merchandising system may be provided on a substantially horizontal surface such as a display shelf or may be provided as the substantially horizontal surface of a display shelf merchandising system. According to alternative embodiments, the elements and the assemblies of the various exemplary embodiments may be applied to a merchandising system provided at any orientation and are not limited to a substantially horizontal surface. The exemplary embodiments shown in the FIGURES may be dimensioned to fit any applicable merchandising system (e.g. shelf, display, grid, etc.). For example, the exemplary embodiments advantageously allow a single merchandising system to be used interchangeably with display shelf merchandising systems of different depths without limiting the storage capacity of the merchandising system to the storage capacity of the smallest merchandising shelf system by providing an enlargeable storage space.

The merchandising system may be incorporated into a display shelf system so that the front wall 46 of the merchandising system 10 is near the front edge of the display shelf system. Articles may be placed in the first space 81 (e.g., storage space, compartment, bin, holder, etc.) of the merchandising system 10 defined by the base 22, the two side members 48, the front wall 46 and the member.

The members defining the space configured to store or display articles may be constructed and assembled as a single member or may be constructed and assembled from multiple members. The members may be arranged to form a storage space. The configuration of the members defining the space may advantageously substitute a member for a fixed rear member. Before an article is placed in the space of the merchandising system, the member may be positioned near the front wall. With the member positioned near the front of the wall, the size of the space available to accept articles is minimal. The biasing mechanism positions the member near the front wall of the merchandising system when no articles are loaded in the merchandising system.

The merchandising system 10 may be initially loaded with articles by either manually positioning the member 60 toward the back of the base 22 and then loading the articles into the expanded space, or by loading the articles through the front and having the articles move the member 60 towards the back of the base 22 as more articles are added to the space. As articles are loaded and the member 60 is moved further from the front wall 46, the tension force in the biasing mechanism 52 may increase. The tension developed in the biasing mechanism 52 may cause the member 60 to apply a force to the articles in the merchandising system 10. The force applied by the member 60 may securably contain the articles within the space defined by the base 22, the two side members 48, the front wall 46, and the member 60. Additionally, the force applied to the articles positions or urges the articles toward the front wall 46 of the merchandising system 10. The biasing mechanism 52 may be adjusted or configured so that the force applied to the articles by the member 60 does not damage the articles.

Once loaded with articles, the merchandising system 10 advantageously allows for the forward movement of the articles after an article is removed. When an article is removed from the front of the merchandising system 10, the remaining articles are positioned forward by the member 60 to fill the void left by the removed article. Moving the remaining articles to the front of the merchandising system 10 maximizes the visibility of the articles by eliminating the possibility that adjacent articles positioned near the edge of the display shelf system could obstruct the view of an article set back from the edge of the display shelf system. Additionally, the movement of the article to the front of the merchandising system reduces the difficulty of trying to reach an article positioned away from the front edge of a display shelf system. Furthermore, the forward movement also eliminates the need to manually reposition all of the remaining articles in the merchandising system after an article has been removed.

The side members 48 of the merchandising system may retain the articles when the articles are stored or presented in the merchandising system. The side members 48 may guide the article as the article is positioned or urged in the merchandising system by the member 60. The front wall 46 may prevent the articles from being urged off the front of the merchandising system. When the member 60 positions or urges the articles toward the front of the merchandising system, the front wall 46 may retain the articles in the merchandising system. According to an alternative embodiment, the merchandising system may be configured so that a front wall 46 is not needed to retain the urged article (e.g., an additional member may be added, the configuration of the base and/or side wall may sufficiently retain the article, the angle of the merchandising system, etc.).

The various exemplary embodiments shown in the FIGURES may advantageously provide for an enlargeable space in which articles may be loaded. The exemplary embodiments may provide for an enlargeable space by eliminating a fixed rear wall. Alternatively, the enlargeable space and/or the member may extend beyond a rear fixed wall. Mounting the first end 70 of the biasing mechanism 52 near the front edge of the base 22 and coacting the second end 72 of the biasing mechanism 52 with the member 60, may eliminate the need for a fixed rear wall to direct or guide the movement of a member 60. Additionally, the members of the merchandising system may be configured to provide approximately the rigidity that a fixed rear wall would provide the merchandising system. As best shown in FIG. 5, the member 60 is configured so that the member 60 may create the second space 82 while remaining slidably engaged to the base 22. The second space 82 created by the member 60 advantageously allows the merchandising system 10 to hold more articles. The base portion 68 of the member 60 may be configured to support articles. As shown in FIG. 5, the base portion 68 of the member 60 can create additional or extra space in which articles may be loaded. As shown in FIG. 5, the member 60 may have a portion which may extend beyond the back of the base 22. Creating an enlargeable space that can hold more articles may advantageously allow for less restocking of the merchandising system 10.

According to a preferred embodiment in which the biasing mechanism is a coil spring, the member may provide at least one platform to support the coil spring. When the member is positioned near the front wall of the merchandising system, the portion of the coil spring that is uncoiled may be minimal. The platform may support the coiled portion of the spring and may further act as a guide for the coiled spring by preventing the coiled spring from interfering with the merchandising system during the movement of the member.

According to a particularly preferred embodiment, as shown in FIG. 5, a member 60 may provide an enlargeable space with approximately 2 inches of additional storage space. Referring to the particularly preferred embodiment, the length of the base 22 and the side walls are approximately 22 inches. Thus, the storage space may be enlarged to approximately 24 inches when the member 60 is extended. Other dimensions of the particularly preferred embodiment include a storage space width of approximately 7.5 inches and a side wall height of approximately 2.5 inches. According to an alternative embodiment, the length of the base 22 and the side walls are approximately 18 inches, the depth of a standard display shelf. Such an alternative embodiment may have a storage space enlargeable to approximately 22 inches, also the depth of a standard display shelf. Alternate dimensions may be used for the particularly preferred embodiment and any alternative embodiments.

The same technique used to initially load the merchandising system may be used to reload the merchandising system as articles are removed. In a particularly preferred mode of operation, the new article is reloaded from the front of the merchandising system as it remains incorporated with the display shelf system.

As shown in the FIGURES, providing an adjustable merchandising system allows for the selective reconfiguration of the merchandising system. Accordingly, the merchandising system may be reconfigured to hold varying sizes of articles. As shown in FIGS. 1, 2, 3 and 7, by activating a "push button" release, the side wall elements may slide to adjust the width of the merchandising system 10.

The various embodiments of the merchandising system shown in the FIGURES may advantageously allow for individual merchandising systems to be positioned adjacently or stacked vertically, providing for selective modularity in the construction and assembly of the merchandising system. According to alternative embodiments, adjacent systems may be coupled to each other with a variety of fasteners, including dovetails, screws, bolts, adhesives, joints, etc.

It is important to note that the construction and arrangement of the elements of the merchandising system as shown in the preferred and other exemplary embodiments is illustrative only. Although only a few embodiments of the present inventions have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. It is important to note that any dimensions shown are dimensions of particularly preferred embodiments, and are not intended to be limited to those dimensions. Elements shown as integrally formed may be constructed of multiple parts or elements show as multiple parts may be integrally formed, the operation of the interfaces may be reversed or otherwise varied, the length or width of the structures and/or members or connector or other elements of the system may be varied, the nature or number of adjustment positions provided between the elements may be varied (e.g., by variations in the number of engagement slots or size of the engagement slots or type of engagement). It should be noted that the elements and/or assemblies of the system may be constructed from any of a wide variety of materials that provide sufficient strength or durability, in any of a wide variety of colors, textures and combinations. It should also be noted that the system may be used in association with a rotating display, or alternatively other, fixed and non-movable displays or any of a wide variety of other surfaces in any of a wide variety of other applications. Accordingly, all such modifications are intended to be included within the scope of the present inventions. The order or sequence of any process or method steps may be varied or re-sequenced according to alternative embodiments. In the claims, any means-plus-function clause is intended to cover the structures described herein as performing the recited function and not only structural equivalents but also equivalent structures. Other substitutions, modifications, changes and omissions may be made in the design, operating conditions and arrangement of the preferred and other exemplary embodiments without departing from the spirit of the present inventions.

What is claimed is:

1. A merchandising system for presenting and storing articles comprising:

a first base having a front edge, a back edge spaced apart from the front edge, a length between the front edge and the back edge, and sides and configured to support the articles;

an assembly movably coupled to the first base for advancing the articles toward the front of the base;

wherein a first side is configured to be coupled to the first base in a first position to define a first space;

wherein the first side is configured to be coupled to the first base in a second position to define a second space; and wherein the assembly comprises a member movable along the length of the first base and configured to extend beyond the back edge of the base to create a third space for containing the articles in addition to the first and second spaces.

2. The merchandising system of claim 1 wherein the first side is not integrally formed with the first base.

3. The merchandising system of claim 1 wherein the first side is configured to directly couple to the first base in the first position and the second position.

4. The merchandising system of claim 1 wherein the member comprises a curved pusher.

5. The merchandising system of claim 1 wherein the member is integrally formed as one piece.

6. The merchandising system of claim 1 wherein the member comprises a substantially vertically oriented portion configured to longitudinally extend beyond the back of the first base to create the third space.

7. The merchandising system of claim 1 further comprising members that adjustably couple the first side to the first base.

8. The merchandising system of claim 7 wherein the members are integrally formed with the first side.

9. The merchandising system of claim 7 wherein the members comprise portions that releasably engage the first base.

10. The merchandising system of claim 9 wherein the portions that releasably engage the first base comprise connectors.

11. The merchandising system of claim 7 wherein the members are configured to be provided in a first configuration and in a second configuration.

12. The merchandising system of claim 11 wherein the members engage the first base in the first configuration and disengage the first base in the second configuration.

13. The merchandising system of claim 12 wherein the second configuration is vertically spaced from the first configuration.

14. The merchandising system of claim 1 wherein the assembly is slidably engaged with the first base.

15. The merchandising system of claim 1 wherein the assembly for advancing the articles further comprises a biasing mechanism that provides a biasing force to the member.

16. The merchandising system of claim 1 wherein the first base has a beveled surface near the back for allowing the articles to advance smoothly.

17. The merchandising system of claim 1 wherein the first base does not include a back wall.

18. The merchandising system of claim 1 wherein the first base comprises one or more projections on at least one side.

19. The merchandising system of claim 18 wherein the projections are configured to couple to a side of a second base.

20. The merchandising system of claim 18 wherein the projections are configured to couple to apertures on a second base.

21. The merchandising system of claim 1 further comprising a panel for displaying article information.

22. The merchandising system of claim 1 wherein the first space and the second space are storage spaces for the articles.

23. A merchandising system for presenting and storing articles comprising:

a first base having a front, a back and sides and configured to support the articles;

an assembly movably coupled to the first base and biased to advance the articles toward the front of the base;

a first side configured to be coupled to the first base in a first position to define a first space, wherein the first side is configured to be coupled to the first base in a second position to define a second space;

at least one member that adjustably couples the first side to the first base, wherein the members are adjustable in an at least partially vertical direction; and wherein the assembly comprises a member configured to extend beyond the base to create a third space for containing the articles in addition to the first and second spaces.

* * * * *